United States Patent [19]

Pauldine

[11] Patent Number: 4,524,788

[45] Date of Patent: Jun. 25, 1985

[54] HAIR ROLLER

[76] Inventor: Donald D. Pauldine, 359 W. Church St., Elmira, N.Y. 14901

[21] Appl. No.: 578,825

[22] Filed: Jan. 10, 1984

[51] Int. Cl.[3] ..... A45D 2/14

[52] U.S. Cl. ..... 132/42 R

[58] Field of Search ..... 132/41 R, 40, 42, 39, 132/33

[56] References Cited

U.S. PATENT DOCUMENTS

| | | | |
|---|---|---|---|
| 1,839,668 | 1/1932 | Gaire | 132/42 R |
| 2,391,284 | 12/1945 | Weiss | 132/42 R |
| 3,419,019 | 12/1968 | Hoffman et al. | 132/41 R |
| 3,438,382 | 4/1969 | Solomon | 132/39 |

*Primary Examiner*—Gregory E. McNeill

*Attorney, Agent, or Firm*—Barnard & Brown

[57] ABSTRACT

An improved hair roller or permanent wave rod comprising a cylindrical member on which the hair is wound, and a flexible strap or band, the cylindrical member and the ends of the strap having self-adhering material which has a high resistance to shear forces in the plane of contact of the material but can be readily separated by force perpendicular to the plane of contact of the material. The rod may have flanged ends to provide an increased area of contact of the material. One type of material suitable for use in the invention is a hook and loop fastening material known as "VELCRO", a registered trademark of Velcro America.

8 Claims, 7 Drawing Figures

FIG. 4
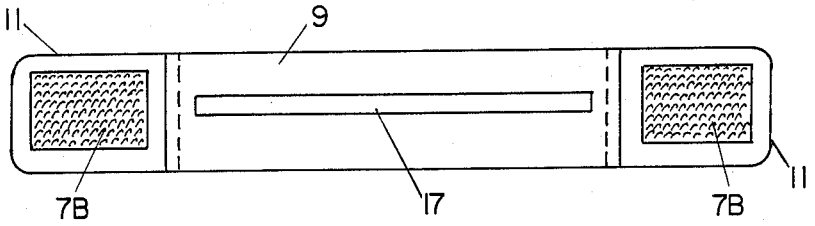
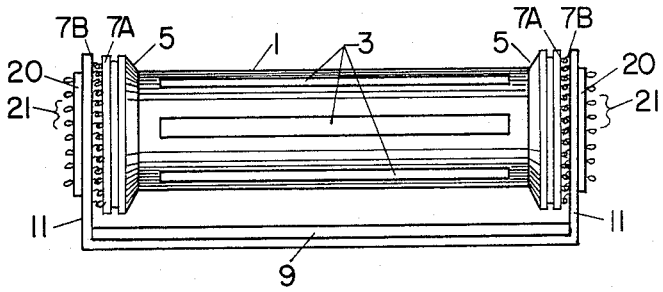
FIG. 5
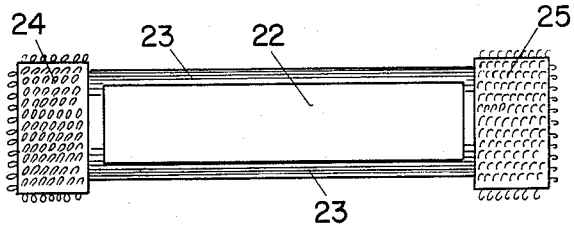
FIG. 6

HAIR ROLLER

FIELD OF THE INVENTION

This invention relates to hair rollers, also known as permanent wave rods, and more particularly, to an improved hair roller having co-operating portions bearing self-adhering materials for attaching a restraining strap to the rod or curler.

BACKGROUND OF THE INVENTION

Permanent wave hair curlers have long been known, of the type in which a cylindrical rod or member is used to roll the hair while it is wet from the permanent waving solution. A strip or band of flexible material is attached at one end to an end of the rod, and the other end of the strip or band is arranged to be attached to the other end of the rod, whereby the hair wound upon the rod is held in place. For example, see Jacobs, U.S. Pat. No. 2,244,707.

The known permanent wave curlers are somewhat inconvenient for the operator in use, since the bands must be relatively accurately aligned with the holding arrangement on the rods, and/or the band must be stretched to perform the attachment. All of this must be accomplished while the rod and strap, the hair, and the operator's fingers are wet and slippery from the permanent waving solution.

Gilman, U.S. Pat. No. 3,923,068, addresses this problem with his magnetic attachment method. Such a rod cannot hold with the required strength, however, as the magnetic attraction has no resistance to the radial or sliding force (perpendicular to the rod axis) generated by the pull on the strap, and insufficient resistance against a pull along the axis of the rod.

Another problem with the prior art rods such as Jacobs or Gilman is the adverse effect that the thin strap has upon the hair compressed underneath. The thin edge gives rise to a "crimp" in the hair, which in turn, promotes breakage. A broader strap would eliminate this problem, but accentuates the inconvenience of use related above, and can add substantially to the complexity and expense of the rod. For example, Thackeray, U.S. Pat. No. 3,433,233, shows a relatively broad strap, which is not adjustable as to position on the end of the rod. If the strap does not "catch" exactly, it will pop off.

A better method of rolling uses a broad strap which is slotted to permit the hair to pass through the strap. The hair is placed against the rod and rolled up toward the hair roots until the rod rests against the strap. The rod must then be secured tightly in place. Past designs of this sort have exhibited some or all of the problems indicated above. Peterson, U.S. Pat. No. 2,123,378, for example, has a ratchet arrangement which is complicated to manufacture, difficult to use, and requires accurate alignment. Polykranas, U.S. Pat. No. 2,754,831, suffers from the same failings. He eliminates the ratchet in favor of a hex fitting into a slot, which method is limited in adjustability, and prone to wearing of the hex. The small metal pieces into which the slot is cut can easily bend, or the strap can flex, resulting in the hex leaving the slot and the hair unrolling.

OBJECTS OF THE INVENTION

Accordingly, a principal object of my invention is to provide a new and improved hair roller which does not require alignment of the strap ends with retaining slots and the like on the roller.

Another object of the invention is to provide an improved hair roller which has a simple and reliable fastening means for attaching a holding strap to the curler rod.

Still another object of my invention is to provide an improved hair roller which permits independent radial adjustments to be made to each end of the holding strap, without alignment problems.

Yet another object of my invention is to provide an improved hair roller which is economical to manufacture, simple to use, sturdy and durable, and easy to adjust.

SUMMARY OF THE INVENTION

In accordance with the present invention, there is provided a curler rod in accordance with conventional shape and dimensions, having flat ends which may be greater in diameter than the body of the rod, as by providing flange surfaces at the ends of the rod. A retaining band of flexible material, which may or may not be elastic, is provided with the curler rod. The band has a center portion which is preferably of the same length as the curler rod, and which is provided with a longitudinal slit at the center of the width of the band, which slit extends for substantially the entire length of the center portion of the band. End portions are provided for the band which can be folded at substantially a right angle to the length of the band. These end pieces can either be integral with the band, or seperate elements suitably joined or attached to the band. The end surface of the rod, and the surface of the end pieces facing the rod, are provided with self-adhering, but separable material having a high shear strength in the plane of the joined surfaces, so that when these surfaces are brought together, they will adhere with a high resistance to slip in the plane of the joined surfaces, and still be relatively easily separated by force in a direction perpendicular to the surfaces. Thus there is provided means for attaching the strap to the rod which is radially adjustable at each end of the rod, and which does not require accurate alignment. Although the parts are readily separable by a force exerted axially of the rod, the strap is held with a high shear strength in directions radially of the rod.

BRIEF DESCRIPTION OF THE DRAWINGS

The foregoing objects and other features and advantages of my invention will become more fully understood from the following detailed description when considered with the accompanying drawings, in which:

FIG. 4 is a bottom view of the holding strap shown in FIG. 2.

FIG. 5 is a side view of an assembled rod and strap.

FIG. 6 is a view of another embodiment of the rod of the present invention in which there is provided a wide slot through the body of the rod.

Similar reference characters refer to similar parts in each of the several views.

DETAILED DESCRIPTION OF THE INVENTION

Figure 1:
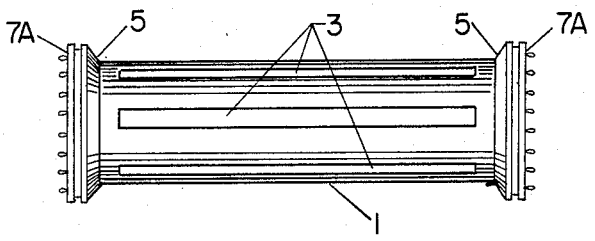
FIG. 1 is a side view of the permanent wave rod.

Referring now to the drawings, FIG. 1 shows a side view of a permanent wave curler rod arranged in accordance with my invention. The rod (1) comprises a cylindrical body, which may have slits (3) therein spaced around the periphery of a hollow rod (1), in accordance with known design of such curler rods. At each end of the rod (1), there is optionally provided a flanged end piece (5), which may be or may not be an integral part of the rod (1). The outward surfaces of the flanged portions (5) are provided with material (7), of matched dimensions which are of the type of self-adhering, separable, and reusable hook and loop material known in the art. One such material is known in the trade as "VELCRO", a registered trademark of Velcro America.

Figure 2:
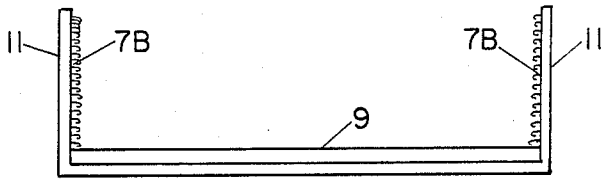
FIG. 2 is a side view of the holding strap provided for each permanent wave rod.

FIG. 2 is a side view of the holding strap arranged in accordance with a preferred embodiment of the invention, showing a flexible band (9) forming the center portion of the strap. At each end of the center portion there are provided end pieces (11), which can be individually formed and attached to the center portion (9) as by cementing, or may be part of the same piece as the center portion.

The outward faces of the end surfaces of the rod (1), and the inwardly facing surfaces of the end pieces (11) comprise mating surfaces of self-adhering material which readily adheres upon suitable contact, but which can be readily parted by appropriate force in a perpendicular direction to the place of the contacting surfaces. Such types of material are characterized by having a high shear resistance in the place of contact of the mating surfaces.

Figure 3A:
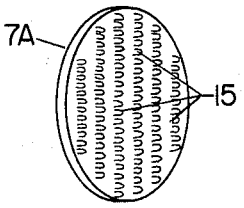
FIGS. 3A and 3B are diagrammatic views showing, in schematic form, one type of self adhering material suitable for use in my invention.
Figure 3B:
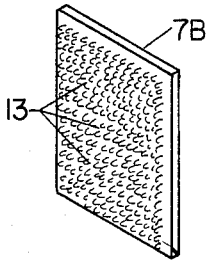

FIGS. 3A and 3B depict, schematically, the appearance of the mating surfaces on the material (7) affixed to the end of the curler rod (*7a*), on flanges (5), and (*7b*) on the inward surface of the end pieces (11), affixed to the strap (9). In FIG. 3A, a large plurality of minuscule hooks are formed on the surface of the material. When the two surfaces are brought together, the hooks (15) engage, the random fashion, the loops (13), so that the two elements (*7a*) and (*7b*) adhere. This type of fastening is characterized by having a high degree of resistance to shear forces, acting in the plane of contacting or mating surfaces, while yet being readily separable by forces exerted perpendicularly to the plane of the mating surfaces.

FIG. 4 is a bottom view of the strap or band (9), showing the slit (17), which extends substantially the length of band (9), and is located centrally of the band (9). The strands of hair to be wrapped upon the curler (1) are passed through the slit in band (9), rolled upon the rod (1), and then the band (9) is attached to rod (1), so that the adhesive material makes contact and thereafter holds the band and rod in the desired juxtaposition.

FIG. 5 is a side view of the assembled curler rod and the retaining strap. It will be apparent that the invention permits the retaining strap to be adjusted at each end to accomodate various thicknesses of hair wrapped around the curler rod. Because of the characteristics of the self-adhering material, the strap will resist displacement in directions radial to the rod.

FIG. 5, according to one embodiment of the invention also shows the addition on the outsides of the end pieces (11) of self adhering material (20) of the same kind as that on the ends of the rod (*7a*), in this case shown as the "loop" (21) half of the "hook and loop" fastening. This permits use of a second strap to "stack" two rollers, or two layers of hair on one roller, together for greater flexibility of use.

FIG. 6 shows another embodiment of the rod (1) of the invention, in which there is provided a wide slot (22) through the body (23) of the rod. This allows an operator to pass a strand of the hair through the rod, which may then be rolled up more easily, and by which means the curl may be placed closer to the head, with the loss of the end of the strand which was in the rod.

As a further option, additional hook (24) and loop (25) material is provided on around the circumference of the rod at each end, to allow two or more rods to attach to each other.

From all of the foregoing, it will be apparent that my invention provides a new and unique hair roller, which is economical to manufacture, and which is easy to use, permitting radial adjustment of the retaining strap and retaining its position, yet permitting easy dissembly.

Although I have herein shown and described only the preferred embodiment of my invention, it will be apparent to those skilled in the art to which the invention pertains, that various changes and modifications may be made to the subject invention, without departing from the spirit and scope thereof, and therefore it is understood that all modifications, variations, and equivalents within the spirit and scope of the subject invention are herein meant to be encompassed in the appended claims.

I claim:

1. A hair roller comprising a cylindrical member having a cylindrical body upon which the hair is wound and end surfaces at the ends thereof; and an elongated strap member, having a center portion substantially the same length as the longitudinal axis of the cylindrical member with a width substantially equal to the diameter of the cylindrical member and end portions at each end of the strap member, which end portions may be folded at substantially right angles to the center portion; the end surfaces of said cylindrical member and the end portions of said strap member each being provided with mating surfaces of self-adhering material, whereby the strap member may be affixed to the cylindrical member at each end.

2. A hair roller as claimed in claim 1, in which said self-adhering material is of the type having high resistance to shear forces in the place of contact between the ends of the cylindrical member and the strap member.

3. A hair roller as claimed in claim 2, characterized by the self-adhering material being a hook and loop material such as VELCRO.

4. A hair roller as claimed in claim 1, characterized by said strap member being formed of flexible material.

5. A hair roller as claimed in claim 4, further characterized by a longitudinal slit extending for substantially the length of the center portion of said strap member.

6. A hair roller as claimed in claim 1 in which the strap member has self-adhering material on both surfaces of the end portions thereof.

7. A hair roller as claimed in claim 1 in which the cylindrical body of the cylindrical member is formed with a slot passing through the body along a substantial portion of its length, such that the hair may be passed through the slot and wound upon the body by rotation thereof along its longitudinal axis.

8. A hair roller as claimed in claim 1 in which the cylindrical body of the cylindrical member is provided with mating strips of hook and loop self-adhering material around its circumference at the ends thereof, having mating hook material and loop material at opposite ends of the cylindrical body.

* * * * *